US008523299B2

(12) United States Patent
Smith

(10) Patent No.: US 8,523,299 B2
(45) **Date of Patent: *Sep. 3, 2013**

(54) FLAT PANEL TV STAND PROVIDING FLOATING APPEARANCE

(75) Inventor: Gordon W. Smith, San Diego, CA (US)

(73) Assignees: Sony Corporation, Tokyo (JP); Sony Electronics Inc., Parkridge, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/311,928

(22) Filed: Dec. 6, 2011

(65) Prior Publication Data

US 2012/0092855 A1 Apr. 19, 2012

Related U.S. Application Data

(63) Continuation of application No. 12/131,269, filed on Jun. 2, 2008, now Pat. No. 8,167,253.

(51) Int. Cl.
*A47B 5/00* (2006.01)

(52) U.S. Cl.
USPC ..... 312/7.2; 312/223.5; 108/23; 108/180; 248/917

(58) Field of Classification Search
USPC ..... 312/7.2, 223.5; 108/93, 23, 180, 108/186; 211/90.01, 119.003, 134, 153; 248/127, 146, 158, 176.1, 917
See application file for complete search history.

(56) References Cited

U.S. PATENT DOCUMENTS

| | | | | | |
|---|---|---|---|---|---|
| RE12,140 | E | * | 8/1903 | Stahmer | 211/27 |
| 1,554,137 | A | * | 9/1925 | Slifkin | 108/6 |
| 1,824,813 | A | * | 9/1931 | Friedemann | 108/108 |
| 2,433,748 | A | * | 12/1947 | Eide | 108/101 |
| 2,477,735 | A | * | 8/1949 | Gentile | 248/220.31 |
| 2,540,353 | A | * | 2/1951 | Schick | 108/92 |
| 3,368,786 | A | * | 2/1968 | Bulman | 248/455 |
| 3,916,549 | A | * | 11/1975 | Storch et al. | 40/746 |
| 4,086,858 | A | * | 5/1978 | Howitt | 108/110 |
| 4,727,992 | A | * | 3/1988 | Sharp | 211/85.2 |
| 4,898,286 | A | * | 2/1990 | Orlandi | 211/187 |
| 5,129,525 | A | * | 7/1992 | Maynard, Jr. | 211/205 |
| 5,171,054 | A | * | 12/1992 | Wilson | 296/37.16 |
| 5,285,501 | A | * | 2/1994 | Castillo | 381/86 |
| 5,416,283 | A | * | 5/1995 | Dault et al. | 181/150 |
| 5,498,050 | A | * | 3/1996 | Maruyama et al. | 296/39.3 |
| D401,084 | S | * | 11/1998 | Martin | D6/474 |
| 6,149,253 | A | * | 11/2000 | Talasani | 312/7.2 |
| 6,276,810 | B1 | * | 8/2001 | Vosshenrich | 362/127 |
| 6,378,709 | B1 | * | 4/2002 | Stuart | 211/87.01 |
| D474,047 | S | * | 5/2003 | Lara | D6/479 |
| D484,332 | S | * | 12/2003 | Niitsu | D6/477 |
| 6,684,815 | B1 | * | 2/2004 | Rakoczy | 119/72 |
| D495,163 | S | * | 8/2004 | Weatherly | D6/479 |
| D502,341 | S | * | 3/2005 | Sexton | D6/477 |
| D516,847 | S | * | 3/2006 | Stenhouse et al. | D6/509 |
| D517,349 | S | * | 3/2006 | Lara | D6/477 |
| 7,120,011 | B2 | * | 10/2006 | Takahashi et al. | 361/679.21 |
| D537,656 | S | * | 3/2007 | Stenhouse et al. | D6/474 |
| D537,658 | S | * | 3/2007 | Tung | D6/479 |

(Continued)

*Primary Examiner* — Alfred J Wujciak
(74) *Attorney, Agent, or Firm* — Sony Corporation

(57) ABSTRACT

A TV stand for a flat panel TV includes a base with plural shelves and a translucent frame on the top shelf. A rear support holds the TV juxtaposed with the translucent frame with the bottom of the TV above the top shelf, so that the TV appears as though it is floating above the top shelf.

3 Claims, 4 Drawing Sheets

(56) References Cited

U.S. PATENT DOCUMENTS

| | | | | |
|---|---|---|---|---|
| 7,195,213 | B2 * | 3/2007 | Weatherly | 248/125.1 |
| D539,565 | S * | 4/2007 | Sexton, III | D6/474 |
| D539,566 | S * | 4/2007 | Anderson et al. | D6/474 |
| 7,261,261 | B2 * | 8/2007 | Ligertwood | 248/129 |
| D566,426 | S * | 4/2008 | Stenhouse et al. | D6/474 |
| D567,546 | S * | 4/2008 | Liu | D6/479 |
| 7,466,540 | B2 * | 12/2008 | Takahashi et al. | 361/679.27 |
| 7,559,668 | B1 * | 7/2009 | Aubrey | 362/140 |
| 8,167,253 | B2 * | 5/2012 | Smith | 248/125.3 |
| 2001/0043520 | A1 * | 11/2001 | Yanagisawa et al. | 369/44.11 |
| 2002/0025593 | A1 * | 2/2002 | Matsuo | 438/31 |
| 2004/0222946 | A1 * | 11/2004 | Noguchi et al. | 345/6 |
| 2004/0233127 | A1 * | 11/2004 | Niitsu et al. | 345/60 |
| 2006/0018092 | A1 * | 1/2006 | Nagano | 361/687 |
| 2006/0191529 | A1 * | 8/2006 | McDonald | 126/500 |
| 2007/0154041 | A1 * | 7/2007 | Beauchamp | 381/306 |
| 2007/0252919 | A1 * | 11/2007 | McGreevy | 348/825 |
| 2008/0096653 | A1 * | 4/2008 | Itskov et al. | 463/31 |
| 2008/0120882 | A1 * | 5/2008 | Mueller | 40/714 |
| 2008/0121146 | A1 * | 5/2008 | Burns et al. | 108/23 |
| 2008/0122325 | A1 * | 5/2008 | Miura et al. | 312/223.1 |
| 2008/0185485 | A1 * | 8/2008 | Watanabe et al. | 248/163.1 |
| 2009/0009947 | A1 * | 1/2009 | Lam et al. | 361/681 |
| 2009/0039212 | A1 * | 2/2009 | Whalen et al. | 248/158 |

* cited by examiner

FLAT PANEL TV STAND PROVIDING FLOATING APPEARANCE

The present application is a continuation of U.S. patent application Ser. No. 12/131,269, filed Jun. 2, 2008, now U.S. Pat. No. 8,167,253.

I. FIELD OF THE INVENTION

This application relates to flat panel TV stands that give the appearance that the TV is floating.

II. BACKGROUND OF THE INVENTION

TV stands have been provided for conventional cathode ray tube TVs. More modern flat panel TVs that use, e.g., liquid crystal display (LCD) or light emitting diode (LED) or other matrix-type technology tend either to require wall mounting, constraining such TVs to one place, or uncertain perches on handy nearby furniture.

SUMMARY OF THE INVENTION

A TV stand for a flat panel TV display has a base with at least a top horizontal shelf and a translucent frame on the top shelf. An upright rear support is configured to hold the TV juxtaposed with the translucent frame with the bottom of the TV above the top shelf, such that the TV appears as though it is floating above the top shelf when mounted to the rear support.

If desired, a lamp can illuminate a bottom portion of the frame. In non-limiting embodiments the base has a bottom shelf resting on ground pads and engaged with the rear support, and in specific implementations a rear edge of the bottom shelf is disposed in a lower groove of the rear support. Also, a translucent middle shelf can be supported by a bracket connected to the rear support with a rear edge of the middle shelf is disposed in a middle groove of the rear support. For stability, the bottom shelf may extend forward of the top shelf relative to the rear support.

In another aspect, a display stand has a translucent frame configured to be juxtaposed with an outer edge of a display and a base coupling the frame to the ground such that a display supported on the base and juxtaposed with the frame appears to float above a surface.

In yet another aspect, a TV stand has a bottom shelf, a top shelf parallel to and spaced above the bottom shelf, and an upright support connecting the shelves. The bottom shelf rests on floor mounts and the support rests on the floor. The bottom shelf is larger in area than the top shelf. A TV can be supported on the stand to appear as though the TV floats above the top shelf.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
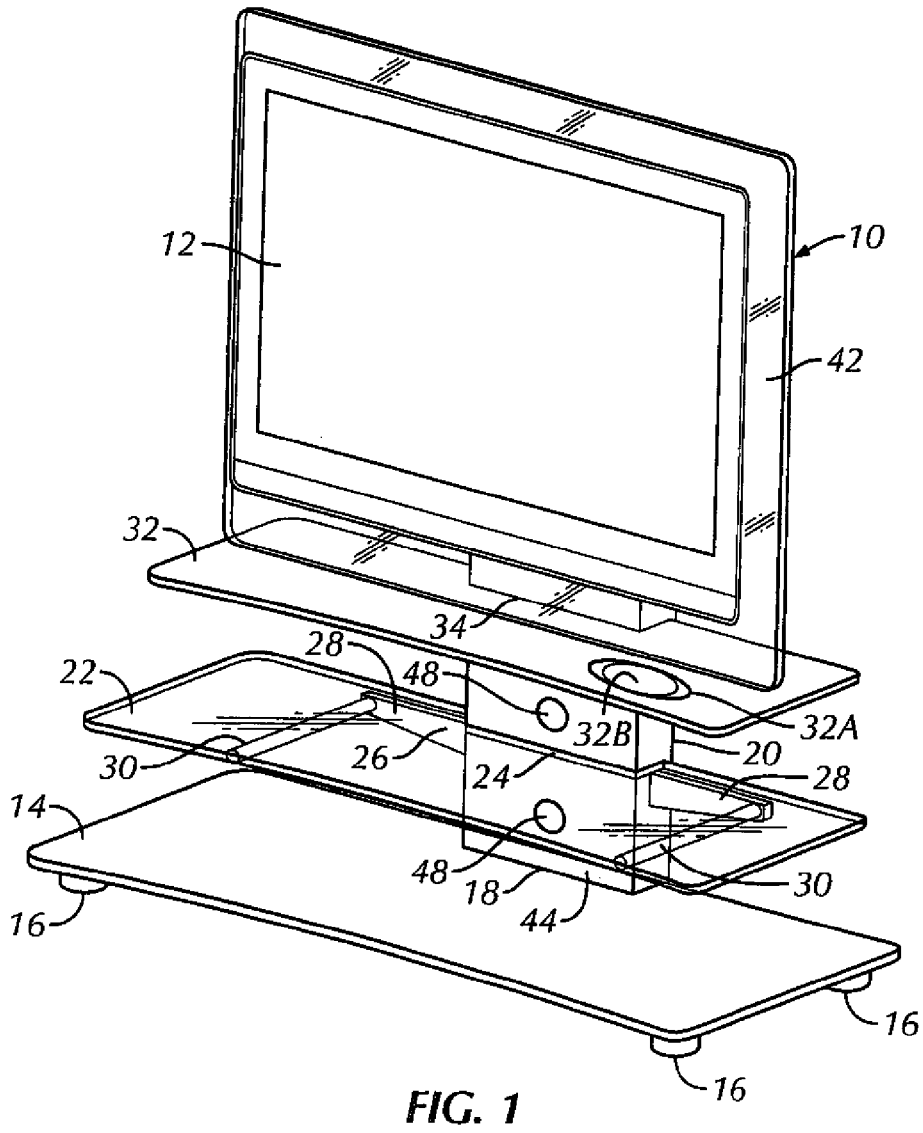
FIG. 1 is a front perspective view of the TV stand supporting a flat panel TV.
Figure 5:
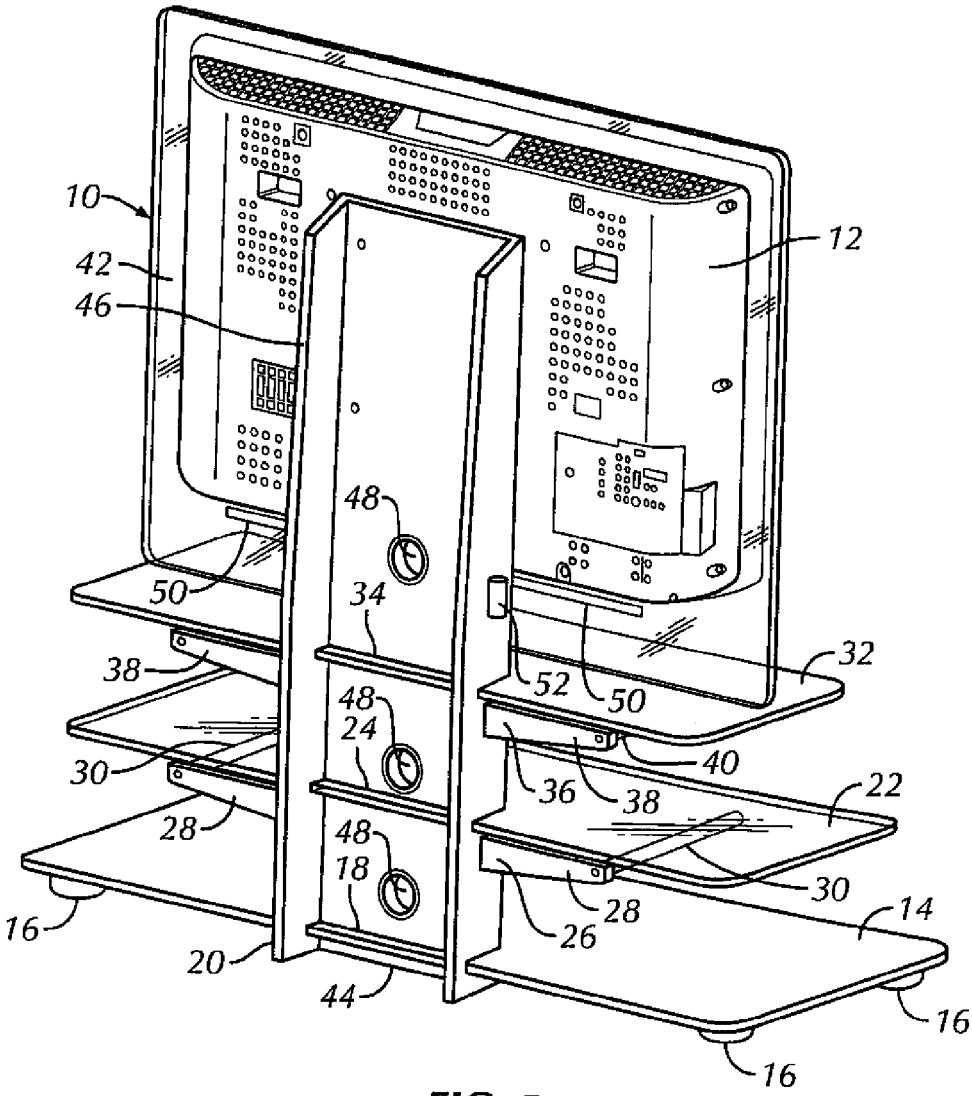
FIG. 5 is a rear perspective view of the TV stand supporting a flat panel TV.

Referring initially to FIGS. 1 and 5, a TV stand 10 supports a TV 12 such as a flat panel LCD or LED or other matrix display. Accordingly, for ease of disclosure directional terms such as "front", "rear", "top", "forward", and the like will be used relative to how the TV 12 is mounted in the intended orientation shown in FIG. 1, with the screen of the TV facing "front". The TV stand is portable so that it may be movably placed in a convenient location of a room and easily moved if desired to another location.

As shown, in one embodiment the TV stand 10 includes a flat horizontal bottom shelf 14, laminated if desired, that rests on floor-contacting pads 16. As perhaps best shown in FIG. 5, the rear edge of the bottom shelf 14 fits into a lower elongated horizontal groove 18 of a generally parallelepiped-shaped, elongated, upright support 20, the bottom of which can be generally coplanar with the bottom surfaces of the support pads 16. Alternatively, the bottom shelf 14 may be connected to the support 20 using brackets and/or threaded fasteners and/or adhesive bonding and/or other appropriate means.

Figure 2:
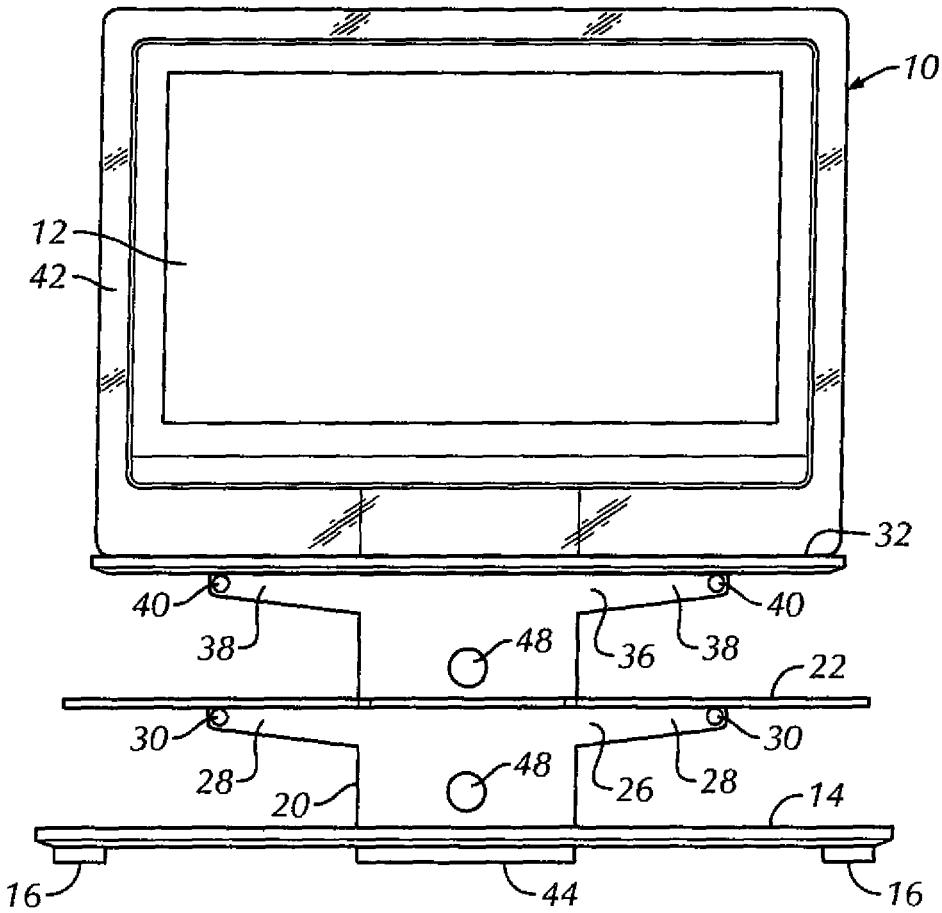
FIG. 2 is a front elevational view of the TV stand shown in FIG. 1.
Figure 4:
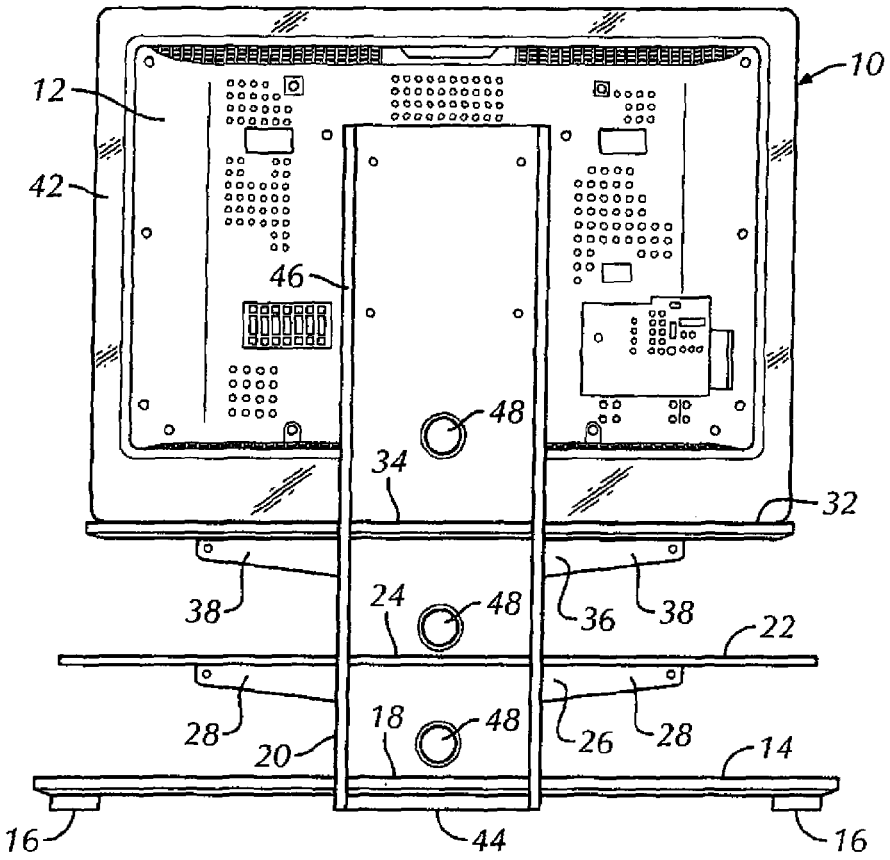
FIG. 4 is a rear elevational view of the TV stand shown in FIG. 1.

A flat horizontal middle shelf 22, which in a non-limiting implementation may be made of translucent or transparent glass, can be parallel to and spaced above the bottom shelf 14 and the rear edge of the middle shelf 22 can rest in a middle elongated horizontal groove 24 of the support 20. A generally horizontal metal shelf support bracket 26 can be attached to the support 20 to support left and right sides of the middle shelf 22 as shown. As best shown in FIGS. 2 and 4, the bracket 26 can include left and right segments 28 that are generally colinear and that extend laterally away from each other to terminate in respective edge support segments 30, which extend from the left and right segments 28 forward and parallel to each other (and, hence, perpendicular to the segments 28). The edge support segments 30 respectively support the left and right edges of the middle shelf 22.

A flat horizontal top shelf 32, which may be made of laminated wood or glass or metal as desired, can be parallel to and spaced above the middle shelf 22 and the rear edge of the top shelf 32 can rest in a top elongated horizontal groove 34 of the support 20. The top shelf 32 can be formed with a receptacle for an audio speaker. A generally horizontal metal shelf support bracket 36 can be attached to the support 20 to support left and right sides of the top shelf 32 as shown. As best shown in FIGS. 2 and 4, the bracket 36 can include left and right segments 38 that are generally colinear and that extend laterally away from each other to terminate in respective edge support segments 40, which extend from the left and right segments 38 forward and parallel to each other (and, hence, perpendicular to the segments 38). The edge support segments 40 respectively support the left and right edges of the top shelf 32. The shelves 14, 22, 32 can become progressively smaller in area from bottom to top, such that the bottom shelf 14 extends forward of the middle shelf 22, for example, adding stability to the TV stand.

As shown in FIG. 1, a hollow rectangular translucent plastic or glass frame 42 can be mounted upright on the top shelf 40. The frame 42 can be various species of translucent, e.g., transparent (clear), color tinted, etc. The frame 42 may be glued or bracketed or fastened to the top shelf 40 and/or the frame 42 can be attached to the rear support 20. In any case, as shown the frame 42 is marginally larger than the screen of the TV 12 sought to be supported. In one implementation the four outer edges of the front of the TV 12 are substantially flush with the four inner edges of the frame 42. Thus, as perhaps best shown in FIG. 2, the TV 12 appears to float above the top shelf 32 with at most the rear support 20 being visible through the frame 42.

Figure 3:
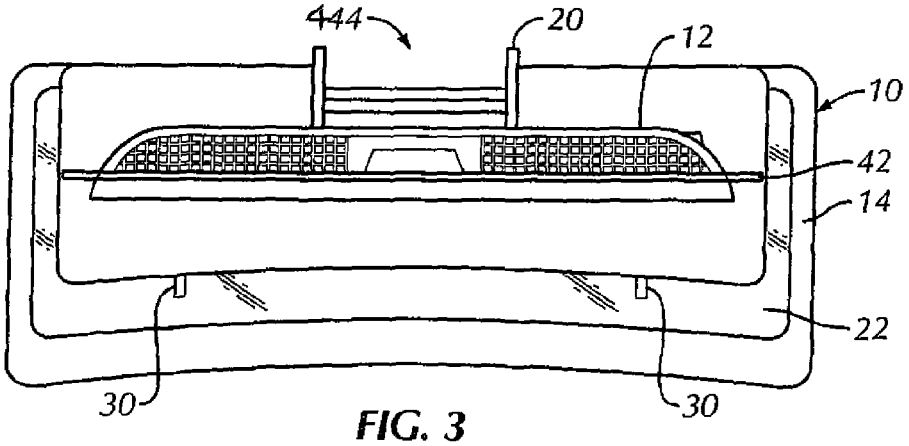
FIG. 3 is a top plan view of the TV stand shown in FIG. 1.

FIG. 3 shows that the rear of each shelf may be formed with a rectilinear cutout 444 that serves as a space for cables to pass through, the cutouts 444 being coaxial in the vertical dimension as shown in FIG. 3. FIGS. 4 and 5 show that the rear support 20 may be made of more than a single piece if desired, e.g., a lower metal support block 44 with the grooves for supporting the middle and top shelves may be surrounded on its front surface and left and right surfaces by a laminated wood or plastic fascia 46. The fascia 46 can rise above the top shelf 32 and can be connected to the TV 12 using threaded fasteners that pass through holes in the fascia 46 that are registered with the rear mounting brackets/holes of the TV 12. The fascia 46 and/or support block 44 can be formed with larger through-openings 48 that establish cable access ports for wire management.

Concluding with FIG. 5, in one embodiment, at least the bottom edge of the frame 42 (and if desired additional edges) may be illuminated by one or more lamps 50. In one embodiment the lamps 50 are LEDs that are disposed inside the bottom edge of the frame and that can be powered by one or more batteries 52 that may be supported on the rear support 20. Or, the LEDs may receive power from the AC grid.

When the bottom segment of the frame 42 is made of clear material, when it is illuminated by the lamp(s) it functions as a light pipe, causing only the edges of the frame to be illuminated and creating a halo effect around the TV. If the translucent frame is not clear but rather is, e.g., color tinted, the illumination caused by the lamp(s) gives the panel a more glowing effect.

While the particular FLAT PANEL TV STAND PROVIDING FLOATING APPEARANCE is herein shown and described in detail, it is to be understood that the subject matter which is encompassed by the present invention is limited only by the claims.

What is claimed is:

1. A TV stand comprising:

a bottom shelf, resting on floor mounts;

a top shelf parallel to and spaced above the bottom shelf, the top shelf being formed with a receptacle configured to hold an audio speaker;

an audio speaker located in the receptacle;

an upright support, resting on a floor, connecting the bottom shelf and the top shelf, the bottom shelf being larger in area than the top shelf, a TV being supported on the stand to appear as though the TV floats above the top shelf, wherein a rear of the bottom shelf and the top shelf is formed with a cutout that serves as an opening for cables to pass through, the cutouts being coaxial in a vertical dimension, at least a portion of the upright support being defined on at least some of its surfaces by a fascia rising above the top shelf and being connected to the TV using fasteners that pass through holes in the fascia that are registered with a complementary structure of the TV; and a translucent frame mounted upright on the top shelf, the upright support being configured to hold the TV juxtaposed with the translucent frame with bottom of the TV above the top shelf, wherein at least a portion of the translucent frame is illuminated by one or more lamps comprising a plurality of light emitting diodes (LEDs) disposed inside the translucent frame to create a halo effect around the TV.

2. The TV stand of claim 1, comprising the bottom shelf resting on ground pads and engaged with a rear support, wherein a rear edge of the bottom shelf is disposed in a lower groove of the rear support.

3. The TV stand of claim 2, comprising a translucent middle shelf, wherein a bracket connected to the rear support supports the middle shelf, wherein a rear edge of the middle shelf is disposed in a middle groove of the rear support.

* * * * *